United States Patent [19]

Easley

[11] 4,229,959

[45] Oct. 28, 1980

[54] METHOD AND APPARATUS FOR OPENING A LOCK

[76] Inventor: Thomas E. Easley, 1303 Fourth St., LaGrande, Oreg. 97850

[21] Appl. No.: 25,402

[22] Filed: Mar. 30, 1979

Related U.S. Application Data

[63] Continuation-in-part of Ser. No. 928,232, Jul. 26, 1978, abandoned.

[51] Int. Cl.[3] ..... E05B 19/20

[52] U.S. Cl. ..... 70/394; 70/413; 33/174 F

[58] Field of Search ..... 70/394, 411, 413; 33/174 R, 174 F, DIG. 1; 81/3 R

[56] References Cited

U.S. PATENT DOCUMENTS

| | | | |
|---|---|---|---|
| 2,437,374 | 3/1948 | Burroughs | 33/DIG. 1 |
| 4,073,166 | 2/1978 | Clark | 70/394 |

*Primary Examiner*—Robert L. Wolfe
*Attorney, Agent, or Firm*—Chernoff & Vilhauer

[57] ABSTRACT

A novel method and apparatus for opening a magnetic cylinder lock of the type having an outer cylinder, a rotatable inner cylinder disposed within the outer cylinder, one or more magnetic pins disposed within chambers of one of the cylinders for engaging the other cylinder to prevent the inner cylinder from rotating, and a keyway within the inner cylinder for insertion of a magnetic key to displace each pin and release the inner cylinder, thereby opening the lock. A probe is provided for insertion within the keyway to determine the presence and polarity orientation of each magnetic pin by detecting its magnetic field. An indexing arm within the probe abuts the lock and provides a signal representative of the position of each pin chamber. Sensor circuitry correlates a signal from the probe representative of the presence and polarity orientation of each pin with a signal from the indexing arm representative of the position of each pin chamber and displays the "combination" of the lock. A selectively-actuable master key with a plurality of electromagnets imbedded therein is provided for insertion into the keyway and a power supply is used to actuate the electromagnets momentarily while turning the master key to displace each pin and open the lock.

15 Claims, 10 Drawing Figures

FIG. 5
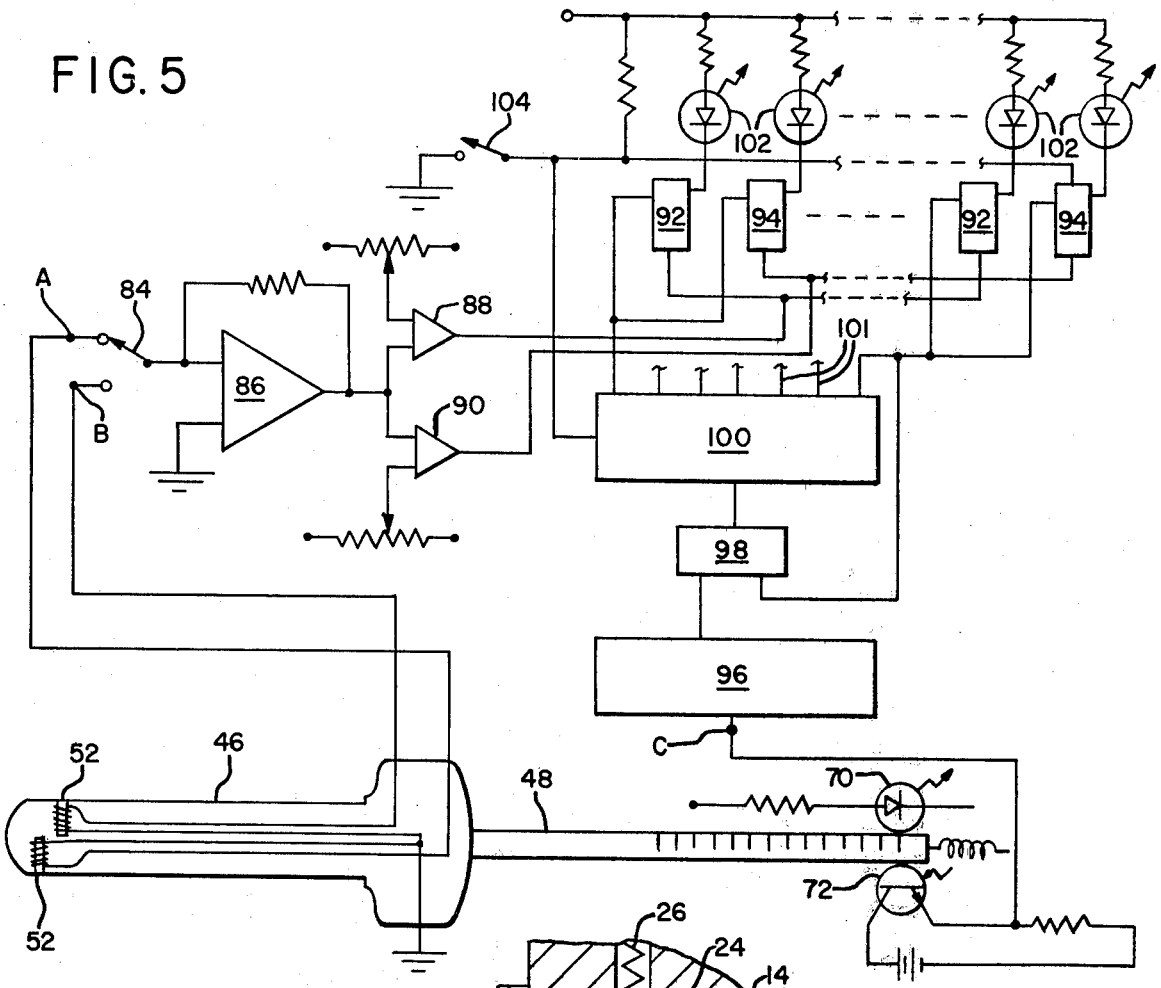
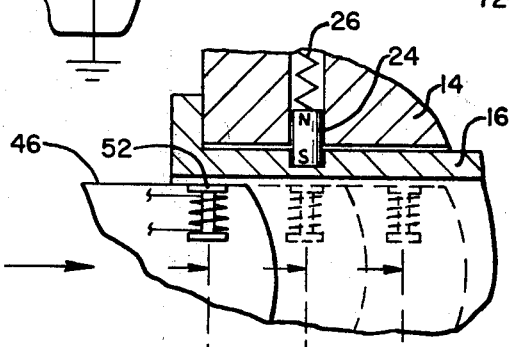
FIG. 7
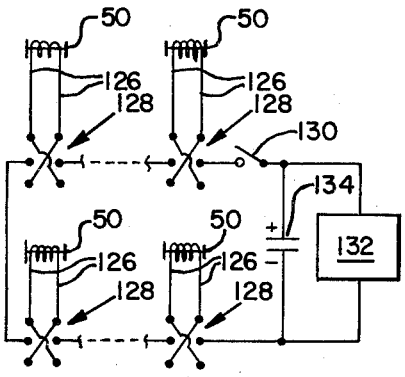
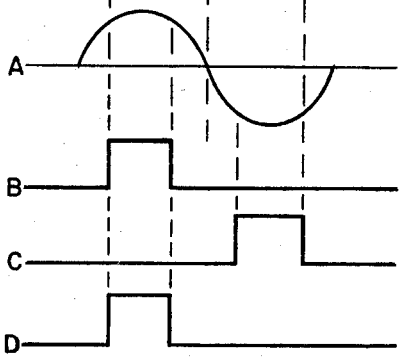
FIG. 4

METHOD AND APPARATUS FOR OPENING A LOCK

CROSS REFERENCE TO RELATED APPLICATIONS

This is a continuation-in-part of application Ser. No. 928,232, filed July 26, 1978 and now abandoned.

BACKGROUND OF THE INVENTION

This invention relates to methods and apparatus for opening locks and, in particular, for opening magnetic cylinder locks.

In the security industry it is frequently desirable, or necessary, to open, or "pick", a lock for which no key is available. Often keys are lost or stolen or are for some other reason unavailable at a time when they are needed, for example in an emergency when they are in the possession of someone who cannot be reached at the moment. Although many types of locks are readily picked under such conditions, the need for greater security often leads to the use of a more nearly foolproof lock which makes the job of opening the lock without a key for legitimate reasons more difficult.

One type of lock which is frequently utilized for security is a conventional cylinder lock having a fixed outer cylinder and an inner cylinder rotatably disposed within the outer cylinder and having a keyway for receiving a key to open the lock, the lock being designed such that rotation of the inner cylinder by a key will release the lock mechanism. Ordinarily the inner cylinder is held in place by an in-line series of pins disposed within respective chambers of the cylinders. Each pin has two parts placed end to end against one another within its chamber, which extends from the outer cylinder into the inner cylinder, and a spring in the outer cylinder which biases the two parts of the pin toward the inside of the inner cylinder. Without a key inserted the part of each pin against which its spring pushes straddles the sheer line between the inner and outer cylinders so that the inner cylinder cannot turn within the outer cylinder. However, when the proper key is placed within the inner cylinder ridges formed along one edge of the key displace the innermost part of each pin a predetermined amount away from the center of the inner cylinder so that the division of the two parts of each pin is positioned at the sheer line between the inner and outer cylinders, thereby permitting the inner cylinder to be rotated relative to the outer cylinder. By varying the dividing point of the two parts of each pin along the length of the pin for each pin a variety of "combinations" for such a lock can be provided.

Since the pins of such a typical cylinder lock protrude into the keyway of the inner cylinder and can be manipulated by devices placed within that keyway there are numerous ways to pick a conventional cylinder lock. With some practice, for example, such a lock may sometimes be picked merely with a bent paperclip. In addition, however, there are also more sophisticated tools for picking such a lock. One type of tool, illustrated by Moore U.S. Pat. No. 3,264,908 and Miskill U.S. Pat. No. 2,565,254, utilizes a blade for placement in the keyway and an apparatus for inducing vibration in the blade, which rapidly moves the cylinder pins in a random fashion, eventually causing the points of division of the pins to be simultaneously aligned with the sheer line so that the inner cylinder may be rotated. A similar type of device, illustrated by Segal U.S. Pat. No. 2,309,677 and Wakstein U.S. Pat. No. 1,977,362, utilizes a blade which may be inserted in the keyway of the inner cylinder and an apparatus for delivering an impact to the blade upon command, thereby moving the pins and possibly placing them in position for rotation of the inner cylinder.

A relatively new type of cylinder lock which completely resists opening by the afore-described methods and apparatus utilizes single-part magnetic pins placed within chambers in the outer cylinder and biased toward the inner cylinder by springs, and a key containing corresponding magnets which displace the pins away from the inner cylinder past the sheer line of the two cylinders so that the inner cylinder may be rotated. The inner cylinder forms a protective sleeve between the lock pins and the key so that the lock pins do not protrude into the keyway where they could be manipulated or examined by a device placed within the keyway; nevertheless, a key having the proper combination of magnets imbedded therein, the magnets being properly oriented with respect to polarity, and placed within the keyway will displace the pins due to the action of the magnetic fields. Thus, the pins cannot be manipulated into position by conventional lock picking apparatus since they are inaccessible, but the lock is readily opened by an appropriate magnetic key.

While magnetic cylinder locks of the afore-described type have the advantage of substantial security, they have the disadvantage that they are not readily openable for legitimate purposes when a key is unavailable. Accordingly, there is a need for a means for opening such a lock other than with its key.

SUMMARY OF THE INVENTION

The subject invention fulfills the need for a means for opening a magnetic cylinder lock by providing a sensor apparatus which may be used to determine the location and polarity of pins within the outer cylinder of such a lock and a key apparatus for selectively displacing the pins according to any predetermined combination thereof.

The sensor apparatus utilizes a probe which is insertable within the keyway of the inner cylinder of a magnetic cylinder lock and contains one or more inductors for generating an electrical current in response to movement through a magnetic field, thereby producing a current representative of the polarity and position of each magnetic pin when the coil passes through its field as the probe is inserted into the inner cylinder. The probe is movably attached to an indexing arm which remains stationary as the probe is inserted into the inner cylinder, and an indexing module placed on the probe identifies positions on the indexing arm corresponding to the pin chambers of the outer cylinder, and provides a signal with which the output of the sensor coils within the probe may be related to the positions of particular magnetic pins.

A readout device receives the signals from the probe coils and the indexing module and processes them to produce a display representative of the polarity and position of each pin in the outer cylinder. A polarity discriminator determines the polarity of the signal generated by the magnetic field of a pin, thereby identifying the polarity of the pin, and provides that signal to a polarity of pairs of memory devices corresponding to the potential pin positions (pin chambers) and polarities. At the same time a counter and decoder circuit identifies which of the pin positions corresponds to a given signal from the sensor coils and also provides that signal to the appropriate pair of memory devices which then record the existence, or nonexistence, and polarity of a magnetic pin in a given position. The memory devices actuate a visual display representative of the information therein, which represents the "combination" of the lock.

Thereafter, the lock is opened utilizing a master key having an electromagnetic placed in each position corresponding to a potential position of a magnetic pin. A power supply for momentarily actuating the electromagnets is provided, their small size requiring a minimum of power dissipation, and a switching network enables any combination of the lock to be selected. Thus, once the combination of the lock is determined by the probe, that combination may be selected on the master key, and the master key may be inserted in the lock and energized, thereby opening the lock.

Accordingly, it is a principal objective of the present invention to provide a new and improved method and apparatus for opening a lock.

It is a further objective of the present invention to provide such a method and apparatus which is particularly adapted for picking a magnetic cylinder type lock by detecting the combination of the lock determined by the respective positions and polarities of the magnetic pins therein and selectively displacing those pins according to that combination.

It is a principal feature of the present invention that it utilizes an electronic probe for insertion within a magnetic cylinder lock to determine the positions and polarities of the magnetic pins therein by detecting the respective magnetic fields thereof.

It is a further feature of the present invention that it utilizes a master key having a plurality of selectively-actuable electromagnets imbedded therein for opening such a lock based upon a predetermined combination.

The foregoing and other objectives, features, and advantages of the invention will be more readily understood upon consideration of the following detailed description of the invention, taken in conjunction with the accompanying drawings.

BRIEF DESCRIPTION OF THE DRAWINGS

FIG. 4 is a graphical illustration of certain signals produced by a sensor device according to the present invention as the probe shown in FIG. 2 is inserted into a magnetic cylinder lock.

FIG. 5 is a simplified schematic diagram of a sensor device according to the present invention.

FIG. 7 is a simplified schematic diagram of a master key according to the present invention.

DETAILED DESCRIPTION OF THE INVENTION

Figure 1A:
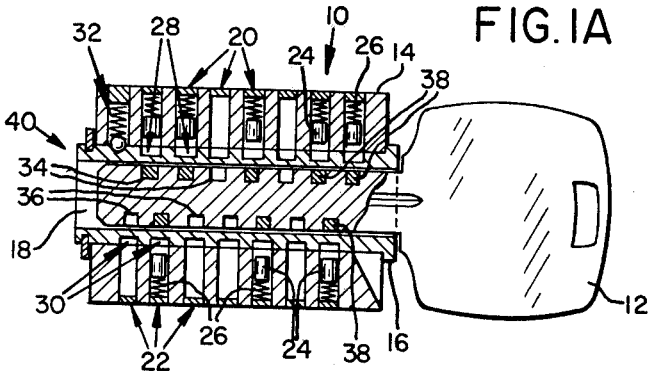
FIG. 1A is a side sectional view of an exemplary magnetic cylinder lock with a key inserted therein.
Figure 1B:
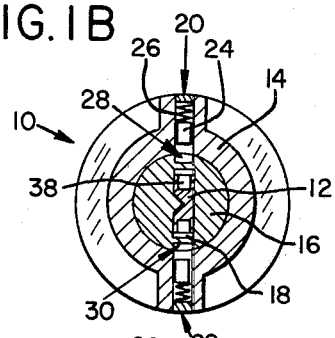
FIG. 1B is a front sectional view of the magnetic cylinder lock of FIG. 1A.
Figure 1C:
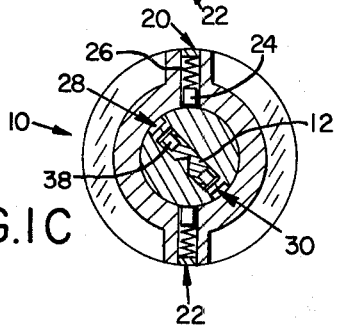
FIG. 1C is a front sectional view of the magnetic cylinder lock of FIG. 1A with an inner cylinder thereof in an unlocked position.

Referring first to FIGS. 1A-1C, wherein the pertinent portions of an exemplary magnetic cylinder lock 10 and an associated key 12 are shown, such a lock typically comprises an outer cylinder 14 within which an inner cylinder 16 is rotatably disposed so that the key may be placed within a keyway 18 for rotation of the inner cylinder, thereby opening the lock. The outer cylinder 14 has a set of upper pin chambers 20 disposed in line with one another, and lower pin chambers 22 which are likewise disposed in line. Selected chambers contain elongate, cylindrical pins 24 which are magnets and whose chamber positions and magnetic polarities are selected according to a predetermined combination. The pins are biased inwardly toward the inner cylinder 16 by respective springs 26, and the inner cylinder has a plurality of upper pin seats 28 placed in line and corresponding in position to the upper chambers 20 and a similar pair of lower seats 30 corresponding to the lower chambers 22, so that when the seats are aligned with their respective chambers the pins 24 will be forced therein by the springs 26, thereby preventing the inner cylinder from rotating within the outer cylinder. The inner cylinder 16 is positioned by a detent 32.

A key 12 for a typical magnetic cylinder lock has a set of upper cells 34, corresponding in position to the upper chambers 20 of the outer cylinder, and lower cells 36, corresponding to the lower chambers 22, for receiving magnets according to a predetermined combination of positions and polarities. Permanent magnets are placed within those cells corresponding to the positions of pins in the upper and lower chambers and having polarities oriented opposite to their respective magnets in the chambers so that the pins in the key will displace the pins in the chambers when the key is inserted in the keyway 18. The force of repulsion of the key and pin magnets is sufficient to displace the pin magnets beyond the sheer line 40 between the inner and outer cylinders so that the inner cylinder may then be rotated to open the lock. After the inner cylinder is rotated the pin may then fall back against the inner cylinder, but the seats 28 and 30 have then been angularly moved, as shown in FIG. 1C, so that the pins cannot pass the sheer line to lock the inner cylinder in place. Since the inner wall of the keyway 18 separates the pins 24 from the inside of the keyway at all times, the lock cannot be picked by conventional lock opening methods.

Alternatively, such a magnetic cylinder lock could be provided whereby the magnetic pins are mounted in the inner cylinder and spring biased outwardly toward the outer cylinder such that those pins would have to be displaced inwardly to open the lock. A key for such a lock would therefore require that its magnets be arranged to attract those pins mounted in the inner cylinder.

Figure 2A:
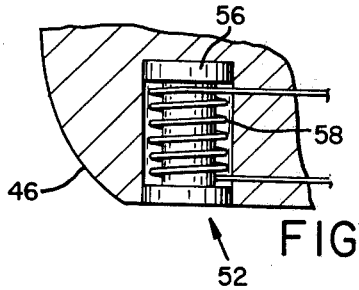
FIG. 2A is a detail view of a sensor coil in the probe shown in FIG. 2.
Figure 2:
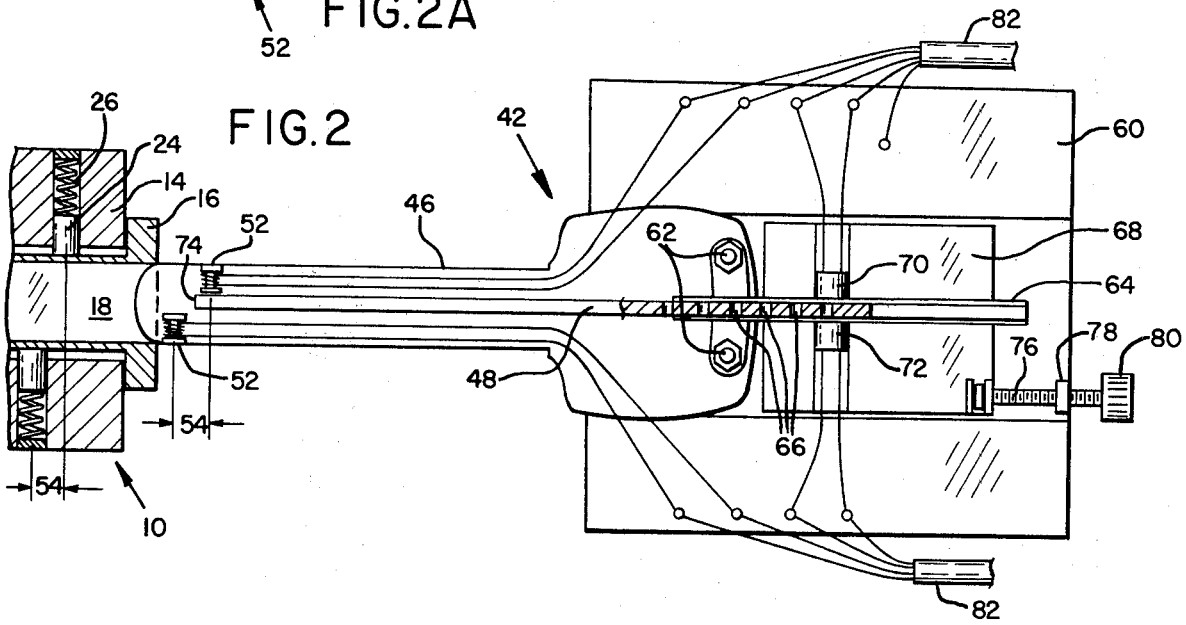
FIG. 2 is a side view of the probe portion of a sensor device according to the present invention, positioned for insertion into a magnetic cylinder lock.
Figure 3:
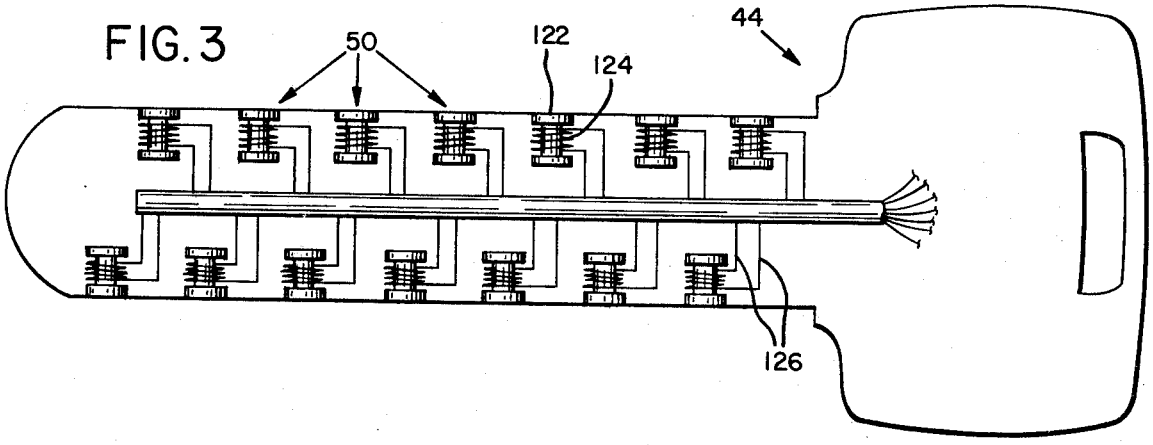
FIG. 3 is a side schematic view of a master key according to the present invention.

Turning now to FIGS. 2 and 3, an exemplary apparatus according to the present invention for opening a lock of the afore-described type basically comprises a sensor device having a probe portion 42 for determining the combination of the lock and a selective master key 44 for opening the lock once the combination has been determined. The probe 42 utilizes a shaft 46 for insertion into the keyway 18 of the lock 10 to detect the magnetic fields of the lock pins, and an indexing arm 48 for determining the positions of the lock pins, and is connected to a readout device for displaying the lock combination.

The master key 44, which is insertable in a keyway 18, utilizes a plurality of tiny electromagnets 50, corresponding to the positions of the cylinders 20 of the lock for selectively displacing the lock pins, either by magnetic attraction or repulsion as is required by the particular type of lock and "combination" thereof, and an energizing device for operating the key. Alternatively, the information from the readout device could be utilized to construct a standard key having the proper combination.

More particularly, as shown in FIGS. 2, 2A and 4, the probe shaft 46 preferably utilizes a pair of sensor coils 52, one being imbedded in the top edge of the shaft and the other being imbedded in the bottom edge of the shaft. Since the chambers 20 of the lock are typically offset from one another in the direction of the longitudinal axis of the keyway, presumably to minimize interference between the magnetic fields of the upper and lower magnetic lock pins, the sensor coils 52 are likewise separated along the longitudinal axis of the shaft by a distance 54, and in order to measure the magnetic fields of those pins placed furthermost back in the lock, the sensor coils 52 are located near the front end of the shaft. In order to induce a current sufficient for detection of the magnetic pin fields the coils 52 preferably comprise a tiny spool 56 of magnetic material and a winding 58 placed thereon having many turns. As the probe is inserted into the keyway, the sensor coils pass consecutively through the fields of the magnetic pins 24, thereby inducing consecutive pulses of current in the windings 58, which can be detected to determine the locations and polarities of the magnetic pins.

The probe 42 preferably includes a base 60 for supporting wire connectors and an indexing device. The probe could be constructed, for example, from a key blank attached to a flat piece of base material by a pair of threaded fasteners 62, as shown in FIG. 2. The indexing arm 48 is slidably mounted on the base 60 by a guide trough 64 which maintains the arm laterally in a fixed position relative to the shaft 46 while permitting the arm to move longitudinally along a dimension parallel to the longitudinal axis of the probe, and the arm defines a plurality of holes 66 therethrough corresponding in their positions relative to one another to the relative positions of the upper and lower pin chambers 20 and 22, respectively, in the lock. An indexing module 68, comprising a light source, such as light emitting diode (LED) 70, and a light detector, such as photodiode 72, is attached to the base 60 straddling the indexing arm 48 in lateral alignment with the holes 66 of the indexing arm so that as the arm moves longitudinally through its guide trough 64 the holes may be positioned between the LED and photodiode to permit light to pass therethrough, but otherwise blocking light transmission. Thus, as the probe 42 is inserted within the keyway 18 the front end 74 of the indexing arm abuts against the outside of the inner cylinder, which causes the indexing arm to remain stationary while the indexing module 68 moves forwardly with the probe and passes by the holes 66 in the arm, thereby producing a series of pulses corresponding to the positions of the chambers 20 and 22 of the lock.

In order to synchronize the pulses produced by the indexing module in time with the positioning of the sensor coils relative to respective chambers, an adjustment device comprising a threaded rod 76 rotatably attached to the indexing module, a tab 78 attached to the base 60, through which the rod 76 is threaded, and a knob 80 for turning the rod, is provided. The knob may be turned to adjust the longitudinal position of the indexing module relative to the positions of the holes 65 therethrough for synchronization. Wires 82 from the sensor coils 52 and indexing module 68 lead to the sensor circuitry.

As illustrated in FIG. 4, when a sensor coil 52 enters the magnetic field of a lock pin 24 a current is generated whose polarity is determined by the polarity of the magnetic lock pin. When the coil is directly beneath the pin the current is reduced to zero, and it reverses when the coil thereafter leaves the field of that pin, as shown on line A of FIG. 4. Thus, the current generated by the sensor coils indicates both the presence and the polarity of a lock pin.

Turning now to FIG. 5 as well as FIG. 4, the sensor circuitry provides a switch 84 for selecting either of the two sensor coils 52 so that some of the same circuitry may be utilized to detect the positions and polarities of both the upper and lower sets of lock pins in two respective separate insertions of the probe. The signal produced by the probe, as shown on line A of FIG. 4, is amplified by an amplifier 86 and fed to a pair of polarity discriminators 88 and 90, the former producing a pulse responsive to current of one polarity from a sensor coil and the latter producing a pulse responsive to current of the opposite polarity. Thus, for example, where the south pole of a magnetic pin is closest to the inner cylinder the discriminator 88 produces a pulse as a sensor coil enters the field of that pin and the discriminator 90 produces a pulse as the coil leaves the field of the pin, as illustrated by lines B and C, respectively, of FIG. 4. The output of one polarity discriminator 88 is connected to a set of memory devices, or "data latches", 92, each such device corresponding to a pin chamber and one potential polarity orientation of a pin therein, and the output of the other polarity discriminator 90 is connected to a matching set of memory devices 94, each such device corresponding to a pin chamber having a pin therein of opposite polarity orientation.

The output of the indexing module is connected first to a pulse conditioning circuit 96 for shaping a pulse generated by a hole 66 in the indexing arm passing through the indexing module 68 and representing a pin chamber. The indexing module is adjusted by the knob 80 so that the pulse generated thereby, as shown in line D of FIG. 4, is synchronized with the first pulse generated by a sensor coil as it enters the field of a magnetic pin. Accordingly, for a magnetic pin of one polarity orientation the output pulse of the conditioning circuit 96 will be synchronized with the output pulse of the polarity discriminator 88 while for the opposite orientation the output pulse of the circuit 96 will be synchronized with the output pulse of the polarity discriminator 90.

The output of the conditioning circuit 96 is connected to the input of a counter 98 which produces a binary signal representative of a number corresponding to the number of pulses produced by the indexing arm during an insertion operation and thus representative of the place in sequence of a given indexing pulse. That number is also representative of the particular pin chamber by which a sensor coil is passing at any given moment.

The output of the counter is fed to a decoder 100 which produces a discreet pulse for each number produced by the counter on an output line 101 representative of that number. The output lines 101 of the decoder are connected respectively to corresponding pairs of memory devices 92 and 94, each pair representing a separate pin chamber so that when two pulses respectively from a polarity discriminator and an output line of the decoder arrive simultaneously at a given memory device the device will be actuated to record that its corresponding chamber contains a pin of a particular polarity orientation. Each memory device is connected to a respective display device, such as an LED 102 for providing a visual indication of the information stored therein, so that together the display devices provide a visual indication of the respective positions and polarities of the pins in the pin chambers. After two insertions of the probe have been made to decode the combination of both the upper and lower chambers of the lock, and the information has been read from the LED's 102, the circuit may be reset by a switch 104 connected to the memory devices 92 and 94 and the decoder 100.

Figure 6:
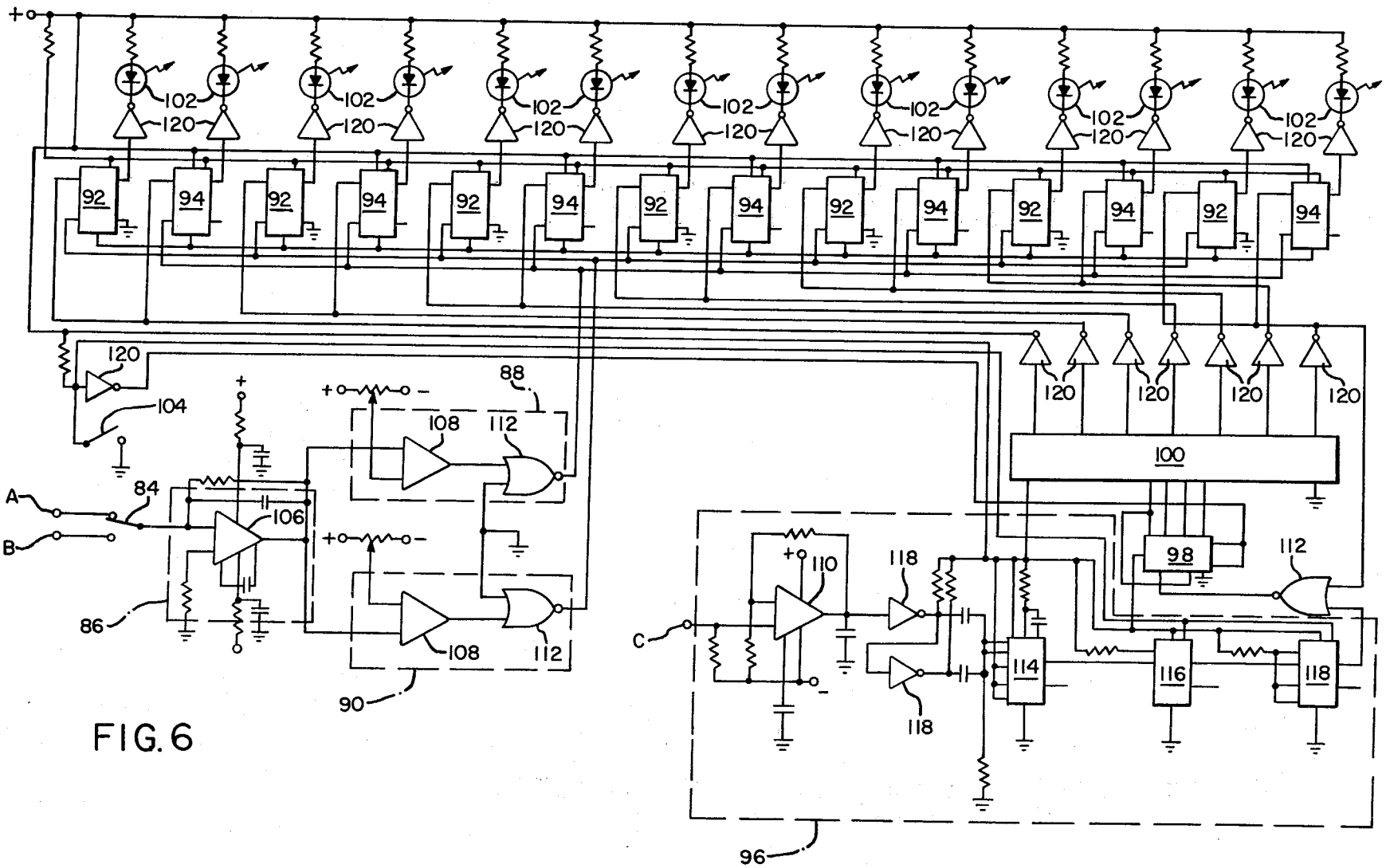
FIG. 6 is a detailed schematic diagram of the device shown in FIG. 5.

A schematic diagram of a specific exemplary circuit constructed according to the preceeding description is shown in FIG. 6. In that schematic the principal components are as follows:

| Reference Character | Description | Manufacturer's Identification |
|---|---|---|
| 92 | Dual D Type Edge Triggered Flip-Flop | Texas Instruments 7474 |
| 94 | Dual D Type Triggered Flip-Flop | Texas Instruments 7474 |
| 98 | Four Bit Binary Counter | Texas Instruments 7493 |
| 100 | BCD to Decimal Decoder | Texas Instruments 7442 |
| 106 | Operational Amplifier | Fairchild 301 |
| 108 | Operational Amplifier | Fairchild 747 |
| 110 | Operational Amplifier | Burr-Brown 3508J |
| 112 | Quad 2 Input NOR Gate | Texas Instruments 7402 |
| 114 | Retriggerable Monostable Flip-Flop | Texas Instruments 74122 |
| 116 | Dual D Type Edge Triggered Flip-Flop | Texas Instruments 7474 |
| 118 | Dual JK Master Slave Flip-Flop | Texas Instruments 7476 |
| 120 | Hex Inverter, Open Collector | Texas Instruments 7405 |

Returning now to FIG. 3, and FIG. 7 as well, once the combination of a lock is displayed by the sensor circuitry the master key 44 may be utilized, or a standard key may be constructed, to open the lock. Since all of the lock pins must be displaced at the same time to open the lock the master key must have a plurality of electromagnets imbedded therein, each corresponding to the position of a lock chamber. Each electromagnet is composed of a tiny spool 122 around which a winding 124 is placed. When current is caused to flow through the winding a concentrated, relatively strong magnetic field is produced, of a polarity corresponding to the direction of the current, for displacing a lock pin 24. Since the polarity of each electromagnet 50 must be individually selectable, both input wires 126 of each electromagnet must be connected to the actuation apparatus.

Each set of input wires 126 is connected to the output of a respective double-pole-double-throw switch 128 for reversing the polarity of the current flow through the winding, and the inputs of the respective switches of all the electromagnets are connected through a switch 130 to a power supply 132. In order to provide a relatively high impedance for the power supply, the electromagnets preferably are wired in series, although it is recognized that other arrangements might be utilized, and to provide a short pulse of energy to the coils, thereby minimizing the heat dissipated by the coils to avoid burning them out, the coils are energized by permitting a capicitor 134 to discharge through them, the power supply 132 serving thereafter to recharge the capicitor.

Accordingly, in order to open a magnetic cylinder lock of the type described herein, the switch 84 of the sensor circuitry is placed in one position corresponding to either of the upper or lower lock chambers 20 or 22, respectively, and the probe 42 is inserted within the keyway 18 of the lock. As the probe is inserted signals are generated by the sensor coils 52 and the indexing module 68 which are detected and decoded by the sensor circuitry to display the positions and polarities of magnetic pins in the set of chambers first selected. The probe is then withdrawn and the switch 84 is switched to the other set of chambers and the probe is reinserted to complete the combination. After the probe has been inserted a second time the entire combination of pins and their respective polarities is displayed by the LED's 120. The combination may then be read and the switches 128 of the master key circuitry set to correspond in polarity thereto. Where there is no magnetic pin in a chamber the setting of its corresponding switch 128 does not matter. The master key 44 is then inserted into the keyway, the switch 130 is closed, and the lock is opened simultaneously by turning the inner cylinder.

It is recognized that while the circuitry described herein is particularly suited to perform the aforedescribed functions, other circuitry might be utilized without departing from the principles of this invention. In particular, for example, circuitry might be provided for determining the positions and polarities of pins in the upper and lower chambers of a lock simultaneously, and for automatically actuating the electromagnets based upon the signals from the sensor probe 42. Circuitry might also be provided for determining the relative field strength, as well as position and polarity, of each of the pins in a magnetic lock in the event that pins of various field strengths are utilized, which could require that the key magnets have various respective field strengths. It is also recognized that other variations in the apparatus might be utilized without departing from the principles of the present invention. For example, the sensor coils 52 and actuating electromagnets 50 might be incorporated in a single probe, other indexing devices not using an optical detector might be utilized, and other devices for detecting the presence of a magnetic field, for example, semi-conductor devices, might be utilized without departing from the principles of this invention.

The terms and expressions which have been employed in the foregoing specification and used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A lock pick apparatus for opening a cylinder lock of the type having an outer cylinder, a rotatable inner cylinder disposed within the outer cylinder for opening the lock upon rotation, one or more magnetic pins disposed within one said cylinder for engaging the other said cylinder to prevent said inner cylinder from rotating, and a keyway within the inner cylinder for insertion of a magnetic key to displace each pin and release the inner cylinder, thereby opening said lock, said apparatus comprising:

(a) means for determining the position and polarity orientation of each said pin by detecting the magnetic field produced thereby; and (b) means for selectively displacing each said pin so that said inner cylinder may be rotated to open said lock.

2. The lock pick apparatus of claim 1 wherein said means for determining comprises an elongate shaft for insertion into said keyway of said inner cylinder; sensor means disposed within said shaft for detecting the presence and polarity orientation of the magnetic field of each said pin; and readout means, responsive to said sensor means, for producing an indication representative of the position and polarity orientation of each said pin without said lock.

3. The lock pick apparatus of claim 1 wherein said means for displacing comprises an elongate shaft for insertion into the keyway of said inner cylinder, and actuating means for selectively producing one or more magnetic fields of predetermined polarity orientation and location within said keyway for displacing each said pin and opening said lock.

4. A sensor device for determining the combination of a cylinder lock of the type having an outer cylinder, a rotatable inner cylinder disposed within the outer cylinder for opening the lock upon rotation, one or more magnetic pins disposed within chambers of one said cylinder for engaging the other said cylinder to prevent said inner cylinder from rotating, and a keyway within the inner cylinder for insertion of a magnetic key to displace each pin and release the inner cylinder, thereby opening the lock, said sensor device comprising:

(a) an elongate shaft for insertion into said keyway of said inner cylinder;

(b) sensor means disposed within said shaft for detecting the presence and polarity orientation of the magnetic field of each said pin; and (c) readout means, responsive to said sensor means, for producing an indication representative of the position and polarity orientation of each said pin within said cylinder.

5. The sensor device of claim 4 wherein said sensor means includes means for producing an electrical sensor signal representative of the presence and polarity orientation of the magnetic field of each said pin and said readout means is responsive to said sensor signal.

6. The sensor device of claim 5 wherein said sensor means comprises an inductor imbedded within said elongate shaft.

7. The sensor device of claim 4 wherein said sensor means comprises means for producing an electrical sensor signal representative of the presence and polarity orientation of each said pin, and said readout means includes indexing means for producing an electrical indexing signal representative of the positions of said chambers of said one cylinder as said shaft is inserted within said keyway and circuit means, reponsive to said indexing signal and said sensor signal, for correlating the position of each said pin with the position of a corresponding chamber.

8. The sensor device of claim 7 wherein said indexing means comprises an arm member slidably attached to said shaft so that as said shaft is inserted within said keyway said arm member abuts against said inner cylinder and remains stationary, said arm member having one or more holes defined therethrough at positions relative to one another corresponding to the positions of said chambers, a light source disposed on one side of said arm, and a light detector disposed on the other side of said arm for producing a signal as a hole passes between said light source and said light detector.

9. The sensor device of claim 7 wherein said circuit means comprises polarity detector means for determining the polarity orientation of each said pin from said sensor signal, means responsive to said indexing signal for producing a signal identifying individual chamber positions, and means responsive to said polarity detector means and said identifying signal for producing a display representative of the presence and polarity orientation of each said pin within a respective chamber.

10. A master key for opening a cylinder lock of the type having an outer cylinder, a rotatable inner cylinder disposed within the outer cylinder for opening the lock upon rotation, one or more magnetic pins disposed within chambers of one said cylinder for engaging the other said cylinder to prevent said inner cylinder from rotating, and a keyway within the inner cylinder for insertion of a magnetic key to displace the pin and release the inner cylinder, thereby opening the lock, said master key comprising:

(a) an elongate shaft for insertion within said keyway; and (b) actuating means for selectively producing one or more magnetic fields of predetermined polarity orientation and location within said keyway for displacing each said pin and opening said lock.

11. The master key of claim 10 wherein said actuating means comprises one or more electromagnets imbedded within said elongate shaft at positions corresponding to respective chambers of said outer cylinder.

12. The master key of claim 11 further comprising power supply means for selectively energizing such said electromagnet by an electrical current of predetermined polarity.

13. A method for opening a cylinder lock of the type having an outer cylinder, a rotatable inner cylinder disposed within the outer cylinder for opening the lock upon rotation, one or more magnetic pins disposed within chambers of one said cylinder for engaging the other said cylinder to prevent said inner cylinder from rotating, and a keyway within the inner cylinder for insertion of a magnetic key to displace each pin and release said inner cylinder, thereby opening said lock, said method comprising:

(a) inserting a magnetic field sensor device within said keyway to produce an indication representative of the presence and polarity orientation of each said pin;

(b) correlating the indication produced in step (a) with the position of said chambers within said lock;

(c) inserting into said keyway a specific key having one or more magnets imbedded therein, said magnets being selected based upon information derived in steps (a) and (b) to displace said pins and thereby open said lock.

14. The method of claim 13 wherein said specific key comprises a master key having one or more selectively actuable electromagnets imbedded therein corresponding in position to said chambers, said step (c) includes actuating selected ones of said electromagnets of said master key based upon the information derived in steps (a) and (b) to open said lock.

15. The method of claim 13 wherein said magnets are permanent magnets selectively imbedded in said key based upon the information derived in steps (a) and (b).

* * * * *

UNITED STATES PATENT AND TRADEMARK OFFICE

CERTIFICATE OF CORRECTION

PATENT NO. : 4,229,959

DATED : October 28, 1980

INVENTOR(S) : Thomas E. Easley

It is certified that error appears in the above-identified patent and that said Letters Patent are hereby corrected as shown below:

| | | |
|---|---|---|
| Col. 2, | Line 65 | Change "polarity" to --plurality--. |
| Col. 3, | Line 9 | Change "electromagnetic" to --electromagnet--. |
| Col. 7, | Line 19 | Change "preceeding" to --preceding--; |
| | Line 29 | After "Type" add the word --Edge--. |
| Col. 8, | Line 56 | Change "and" to --are--. |
| Col. 9, | Line 19 | Change "without" to --within--. |
| Col. 10, | Line 36 | Change "such" to --each--; |
| | Line 61 | Change "said" second occurrence to --and--. |

Signed and Sealed this

*Twenty-fourth* Day of *March 1981*

[SEAL]

*Attest:*

RENE D. TEGTMEYER

*Attesting Officer*

*Acting Commissioner of Patents and Trademarks*